US011918163B2

(12) United States Patent
Dingert et al.

(10) Patent No.: US 11,918,163 B2
(45) Date of Patent: Mar. 5, 2024

(54) CLEANING SYSTEM

(71) Applicant: CARL FREUDENBERG KG, Weinheim (DE)

(72) Inventors: Uwe Dingert, Abtsteinach (DE); Carlo Messineo, Milano (DE)

(73) Assignee: CARL FREUDENBERG KG, Weinheim (DE)

( * ) Notice: Subject to any disclaimer, the term of this patent is extended or adjusted under 35 U.S.C. 154(b) by 600 days.

(21) Appl. No.: 17/059,271

(22) PCT Filed: May 15, 2019

(86) PCT No.: PCT/EP2019/062425
§ 371 (c)(1),
(2) Date: Nov. 27, 2020

(87) PCT Pub. No.: WO2019/228799
PCT Pub. Date: Dec. 5, 2019

(65) Prior Publication Data

US 2021/0204790 A1 Jul. 8, 2021

(30) Foreign Application Priority Data

May 28, 2018 (DE) ..... 10 2018 112 658.1

(51) Int. Cl.
*A47L 13/58* (2006.01)

(52) U.S. Cl.
CPC ..... *A47L 13/58* (2013.01)

(58) Field of Classification Search
CPC ..... A47L 13/58
See application file for complete search history.

(56) References Cited

U.S. PATENT DOCUMENTS

| | | | | |
|---|---|---|---|---|
| 3,205,863 | A | 9/1965 | Kent | |
| 2012/0047675 | A1* | 3/2012 | Chu | A47L 13/58 15/260 |

FOREIGN PATENT DOCUMENTS

| | | | |
|---|---|---|---|
| CN | 202214630 | U | 5/2012 |
| CN | 203693520 | U | 7/2014 |
| EP | 3000375 | A1 | 3/2016 |
| EP | 3003375 | | 4/2016 |
| WO | 2011000332 | A1 | 1/2011 |

* cited by examiner

*Primary Examiner* — Randall E Chin
(74) *Attorney, Agent, or Firm* — LEYDIG, VOIT & MAYER, LTD.

(57) ABSTRACT

A cleaning system includes: a bucket; a liquid-permeable basket located in the bucket, the basket being settable into rotation using a first actuating device and is arranged so that a height of the basket is adjustable in the bucket using a second actuating device; and a cleaning device having a cleaning textile, the cleaning device having a handle on a side facing away from the cleaning textile. The basket is can be both a wash-out basket and a spin-dry basket for the cleaning textile. The second actuating device includes the handle and a ballpoint-pen mechanism, by which the basket is positionable in a first position lowest in the bucket and a second position highest in the bucket by moving the handle up and down.

7 Claims, 3 Drawing Sheets

CLEANING SYSTEM

CROSS-REFERENCE TO PRIOR APPLICATIONS

This application is a U.S. National Phase application under 35 U.S.C. § 371 of International Application No. PCT/EP2019/062425, filed on May 15, 2019, and claims benefit to German Patent Application No. DE 10 2018 112 658.1, filed on May 28, 2018. The International Application was published in German on Dec. 5, 2019 as WO 2019/228799 under PCT Article 21(2).

FIELD

The invention relates to a cleaning system comprising a bucket and a liquid-permeable basket located in the bucket, wherein the basket can be set into rotation using a first actuating device and a cleaning device having a cleaning textile, wherein the cleaning device has a handle on the side facing away from the cleaning textile and wherein the basket is designed as a spin-dry basket for the cleaning textile.

BACKGROUND

Such a cleaning system is generally known. The bucket comprises two chambers arranged next to one another, wherein a liquid for washing out and cleaning the cleaning textile is located in one of the chambers and a spin-dry basket is arranged in the other chamber in order to be able to spin dry the previously washed-out cleaning textile.

The washing out and cleaning of the cleaning textile is carried out in that the cleaning device with the cleaning textile fastened thereto is washed out by immersing it in the liquid and swinging it back and forth therein. The cleaning device with the washed out cleaning textile is moved into the spin-dry basket and spin dried there. The spin drying is carried out in such a way that the spin-dry basket and the cleaning textile arranged therein are set into rotation by means of the first actuating device. The cleaning textile is spin dried by centrifugal force.

The first actuating device is usually a foot pedal.

Moreover, a further cleaning system with a wringing device, which has a funnel-shaped wringing basket, is known. The wringing device can be detached non-destructively and clipped onto the upper edge of a bucket in a form-fitting manner. The cleaning textile, for example textile cleaning fringes arranged on a mop head, can be inserted from above into the wringing basket and then pressed into the basket by means of the handle of the cleaning device. In doing so, cleaning liquid is pressed out of the cleaning fringes. When the mop head is pushed into the wringing basket, it reduces its external diameter by means of articulated slats proportionally to the pressure exerted by the user on the mop head and thus on the cleaning fringes by means of the handle. This additionally supports the pressing out of the cleaning liquid from the cleaning fringes.

The handling of the previously known cleaning systems is less user-friendly, in particular less easy to handle, because the cleaning device with the cleaning textile located thereon has to be transferred between different chambers in the bucket from washing out to spin drying, or because considerable forces are required in order to be able to wring out the cleaning textile sufficiently strongly; for example, in order to subsequently be able to clean sensitive surfaces with only a slightly moist cleaning textile.

SUMMARY

In an embodiment, the present invention provides a cleaning system, comprising: a bucket; a liquid-permeable basket located in the bucket, the basket being settable into rotation using a first actuating device and is arranged so that a height of the basket is adjustable in the bucket using a second actuating device; and a cleaning device having a cleaning textile, the cleaning device having a handle on a side facing away from the cleaning textile, wherein the basket is configured both as a wash-out basket and as a spin-dry basket for the cleaning textile, and wherein the second actuating device comprises the handle and a ballpoint-pen mechanism, by which the basket is positionable in a first position lowest in the bucket and a second position highest in the bucket by moving the handle up and down.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
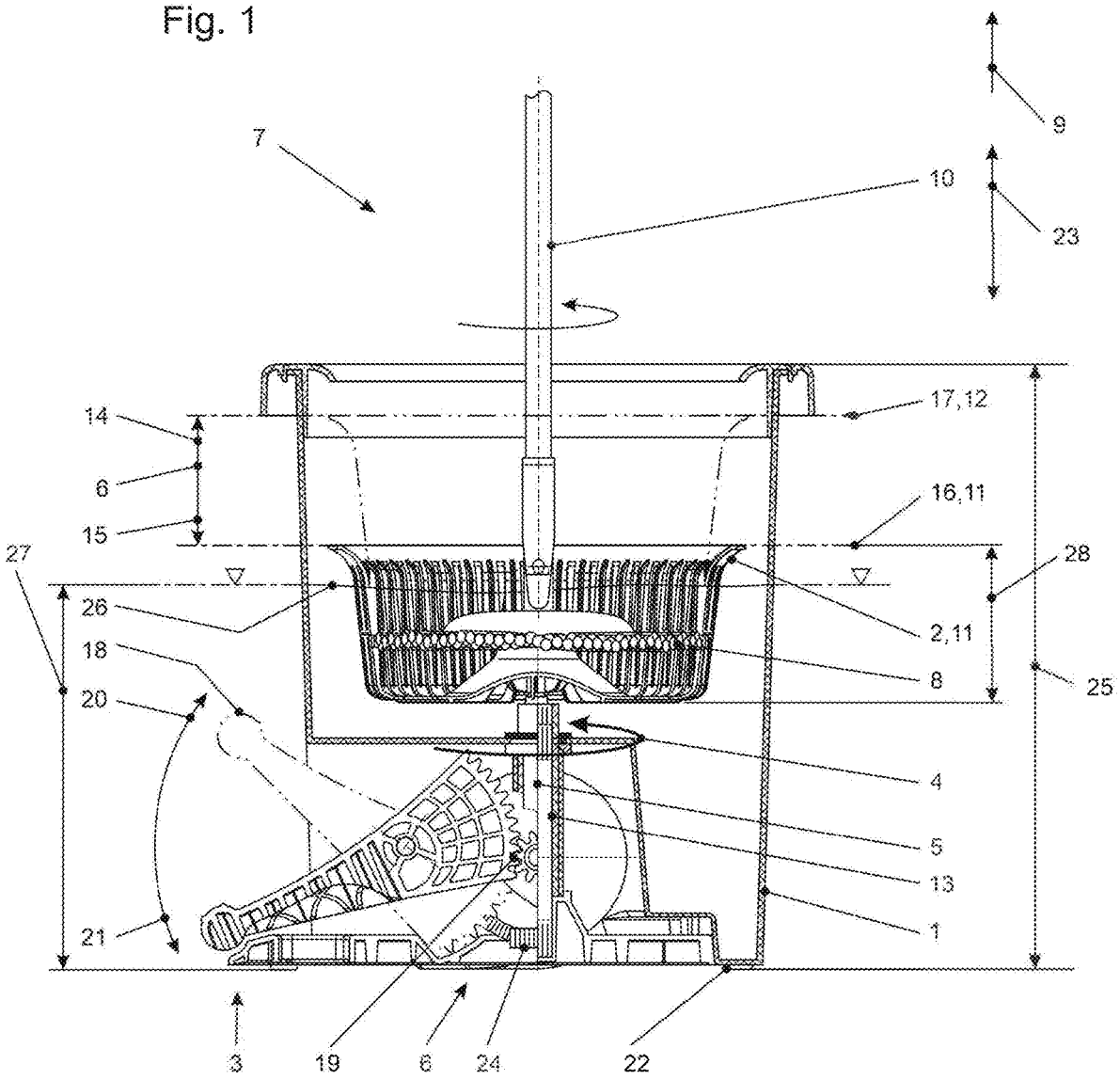
FIG. 1: the described cleaning system during the washing out the cleaning textile.

In an embodiment, the present invention provides a cleaning system of the type mentioned in the introduction in such a way that it has more compact dimensions and that its use is simplified.

To achieve the object, a cleaning system is provided, comprising a bucket and a liquid-permeable basket located in the bucket, wherein the basket can be set into rotation using a first actuating device and is arranged so that its height can be adjusted in the bucket using a second actuating device, and a cleaning device having a cleaning textile, wherein the cleaning device has a handle on the side facing away from the cleaning textile and wherein the basket is designed both as a wash-out basket and as a spin-dry basket for the cleaning textile, wherein the second actuating device comprises the handle and a ballpoint-pen mechanism, by means of which the basket can be positioned in a first position lowest in the bucket and a second position highest in the bucket by moving the handle up and down.

In this case, it is advantageous that the bucket has particularly compact dimensions. For washing out and spin drying the cleaning textile, one and the same basket is used, which is arranged to be height adjustable in the bucket. The position of the height depends on the respectively desired function. When the basket is used as a wash-out basket, the basket is arranged in its lowest first position in the bucket and is at least essentially completely surrounded by liquid.

In contrast, when the basket is used as a spin-dry basket, it is positioned in its second position highest in the bucket and arranged at least essentially completely outside the liquid.

Both during washing out and during spin drying of the cleaning textile, the basket is set into rotation by the first actuating device. As a result, the cleaning textile is not only particularly effectively spin dried, as is known from the prior art, but is washed out effectively and thoroughly beforehand when the rotating basket is in its lowest first position in the bucket. The compact dimensions also result because the basket is always moved up and down coaxially in bucket.

In order to realize such an up-and-down movement of the basket in the bucket, the ballpoint-pen mechanism is provided, by means of which the basket can be positioned in the first position lowest in the bucket and the second position highest in the bucket, by moving the handle up and down.

A ballpoint-pen mechanism as such is known in the art and is known, for example, from U.S. Pat. No. 3,205,863.

When applied to the described cleaning system, starting from the lowest first (washing out) position of the basket in the bucket and the cleaning textile which is already washed out, this means that the basket is pulled upward in the axial direction by means of the handle up to a stop in the ballpoint-pen mechanism, wherein the basket is subsequently lowered only briefly to its second position highest in the bucket. The basket now has the function of a spin-dry basket. The spin-dry basket is set into rotation by the first actuating device. The cleaning textile located in the spin-dry basket is thereby spin dried.

To this end, the cleaning device is pulled upwards out of the basket in the axial direction and initially takes the basket with it, up to the aforementioned stop in the ballpoint-pen mechanism. When the handle is pulled further in the axial direction, the cleaning device then detaches from the basket and the basket in the bucket automatically descends into its lowest first position in the bucket. The basket, which then has the function of a wash-out basket, is prepared for the next washing out of the cleaning textile.

If the cleaning textile is then washed out again after it has been used, it is placed from above into the wash-out basket and, as a result, like the basket, is also surrounded by liquid. Subsequently, the first actuating device is actuated. The basket is thereby set into rotation and the cleaning textile is thoroughly washed out. Thereafter, as previously described, the handle is pulled upward in the axial direction, up to the stop, and subsequently descends to the level of the second position highest in the bucket. The basket and also the cleaning textile located in the basket are then completely in the open. The cleaning textile is then dewatered again by the rotational movement of the basket.

By using the ballpoint-pen mechanism for adjusting the height of the basket in the bucket, the cleaning system can be produced easily and cost-effectively, has compact dimensions as described above and can be operated by the user simply because intuitively.

The first actuating device may include a lever and a transmission, wherein the lever and the transmission are functionally connected to translate an up and down movement of the lever into the rotational movement of the basket in its lowest first and highest second position. The lever is preferably formed by a foot lever, which is arranged pivotally in the region of the bottom of the bucket.

The transmission can bring about a rapid transmission, such that an up-and-down movement of the lever at normal speed leads to a high rotation speed of the basket. The first actuating device can comprise a freewheel, such that the basket and the cleaning textile arranged therein, once driven, remains in rotation, at least briefly, even if the actuating pedal is no longer actuated.

In the lowest position of the basket in the bucket, the basket is preferably completely surrounded by cleaning liquid. In this case, it is advantageous that the cleaning textile is completely immersed in the cleaning liquid when being washed out. The cleaning textile is therefore washed out particularly rapidly and thoroughly.

In contrast, if the basket is located in its second position highest in the bucket, it is preferably arranged completely above a liquid level in the bucket.

The bucket may have a bottom which forms an abutment for the ballpoint-pen mechanism and limits the lowest first position. The ballpoint-pen mechanism is preferably arranged in the axial direction between the basket and the bottom. By arranging the ballpoint-pen mechanism in the center of the basket, an adverse canting and wear of the ballpoint-pen mechanism during its use is reduced to a minimum. The cleaning system thus has consistently good use properties during a long service life.

The basket and the cleaning appliance are detachably connected to one another, preferably by means of a coupling, in a manner that is rotationally fixed along with resistant to tensile stress in an axial direction and non-destructive. By means of such a coupling, the basket can be taken along in the axial direction by moving the handle of the cleaning device up and down. The ballpoint-pen mechanism is thereby actuated and the basket is moved back and forth within the bucket between the lowest and the highest position.

For effective washing out and subsequent spin drying of the cleaning textile, it is necessary for the rotational movement of the basket to be transferred in as slip-free a manner as possible to the cleaning textile and thus to the cleaning device, such that cleaning textile and cleaning device rotate at the same speed of rotation as the basket itself.

The tensile force, which is transmitted by the coupling between the cleaning device and the basket, must be dimensioned in such a way that the ballpoint-pen mechanism can be reliably actuated on the one hand and that, on the other hand, the cleaning device can easily be removed from the basket after the spin drying of the cleaning textile.

For this purpose, the coupling transmits a tensile force which corresponds at least to the weight force of the basket during the intended use of the cleaning system. As a result, the basket fastened to the cleaning device by means of the coupling can be pulled in the axial direction from its lowest first position into its highest second position.

Moreover, the coupling transmits a tensile force that is less than the weight force of the liquid-filled bucket. As a result, the transmittable tensile force is by no means so great that the liquid-filled bucket gets caught on the upward-moving handle of the cleaning device if the cleaning device is to be removed from the basket after the cleaning textile has been spin dried. Following the spin drying of the cleaning textile, the cleaning device is moved axially upward on the handle up to the stop of the ballpoint-pen mechanism. Subsequently, the coupling between the basket and the cleaning device detaches, because the tensile force is no longer transmitted, releases the cleaning device for its intended use, and the basket automatically descends back into its first position lowest in the bucket.

The coupling can be designed as a locking and/or magnetic coupling. A magnetic coupling has the advantage that the coupling between the basket and the cleaning device takes place largely automatically. This is advantageous when the user's view of the coupling is restricted when the cleaning device is being placed into the basket.

During the intended use of the cleaning system, the bucket can have a mean water level at the height of the bucket, wherein it is preferably provided that the cleaning textile and the basket in the lowest first position are arranged completely below the mean water level in the bucket and in the highest second position completely above it. In the lowest first position, the cleaning textile is washed out particularly thoroughly, whereas in the highest second position it is particularly effectively spin dried. Such a functional separation is of crucial advantage for good use properties.

The bucket may have a maximum internal height that can be filled and that corresponds essentially to twice the height of the mean water level in the bucket and essentially to twice the height of the basket. Such size ratios have proven to be advantageous in particular because one and the same cleaning system can be used, on the one hand, to wash out the cleaning textile and, on the other hand, to spin dry the cleaning textile previously washed out. Although a complete functional separation as described above is provided by such an embodiment, the cleaning system nevertheless has compact dimensions overall and can be operated in a simple manner.

FIG. 1 shows an exemplary embodiment of the cleaning system according to the invention, wherein the cleaning system comprises the bucket 1, the liquid-permeable basket 2 arranged in the bucket 1 and the first actuating device 3 in the form of a lever 18, in order to set the basket 2 into rotation 4. The first actuating device 3 comprises, in addition to the lever 18 embodied, for example, as a foot pedal, a transmission 19 to which the lever 18 is functionally connected. This translates the upward 20 and downward movement 21 of the lever 18 into rotation 4 of the basket 2. Regardless of whether the basket 2 is in its lowest first 16 or its highest second position 17, the basket 2 can be set into rotation 4 by the first actuating device 3.

Moreover, the basket 2 is arranged inside the bucket 1 in a height-adjustable manner. In order to be able to adjust the height 6 of the basket 2 in the bucket 1, the second actuating device 5 is provided, which comprises the handle 10 and a ballpoint-pen mechanism 13 by means of which the basket 2 can be positioned in a first position 16 lowest in the bucket 1 and a second position 17 highest in the bucket by means of the up and down movement 15 of the handle 10. The cleaning device 7 is provided with the cleaning textile 8. The cleaning textile 8 is formed here by way of example by cleaning fringes. The handle 10 of the cleaning device 7 is arranged on the side 9 facing away from the cleaning textile 8. At the bottom of the bucket, in the lowest first position 16, the basket 2 forms a wash-out basket 11, in its highest second position 17 by contrast it forms a spin-dry basket 12.

The bottom of the bucket 1 is provided with reference sign 22.

The bucket 1, the basket 2 and the ballpoint-pen mechanism 13 are arranged coaxially with respect to one another, wherein the ballpoint-pen mechanism 13 is arranged between the basket 2 and the bottom 22 in the axial direction 23 of the handle 10 arranged in the basket 2 during the intended use.

Between the basket 2 and the cleaning device 7, the coupling 24 is provided which detachably connects the basket 2 and the cleaning device 7 to one another in a rotationally fixed manner and in the axial direction 23 in a manner that is resistant to tensile stress and yet non-destructive.

Figure 2:
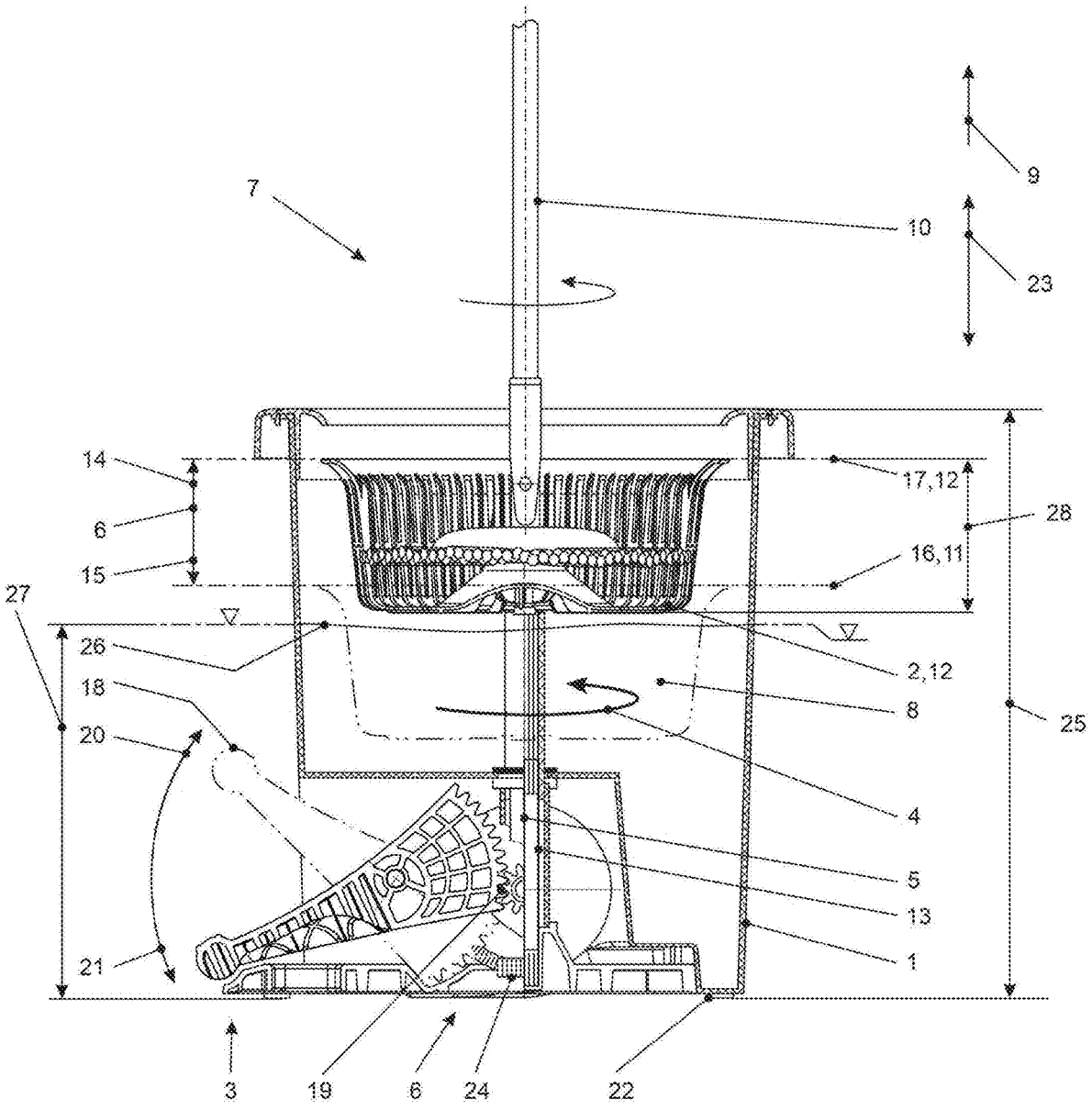
FIG. 2: the cleaning system from FIG. 1 during the subsequent spin drying of the cleaning textile.

During the intended use of the cleaning system, the bucket 1 has a mean water level 26 at the height 27 of the bucket 1, wherein the cleaning textile 8 and the basket 2 in the lowest first position 16 are arranged completely below the mean water level 26 in the bucket 1 and in the highest second position completely above it, as shown in FIG. 2.

The bucket 1 has a maximum internal height 27 that can be filled and that corresponds essentially to twice the height of the mean water level 26 in the bucket 1 and essentially to twice the height 28 of the basket 2. As a result, the bucket is only as high as is absolutely necessary for the functions described. Overall, the cleaning system thereby has compact dimensions not only in diameter but also in height 25 and can thereby be easily handled by the user.

The cleaning device 7 with its cleaning textile 8 is arranged in the wash-out basket 11. The wash-out basket 11 and the cleaning textile 8 are each arranged in the lowest first position 16 completely below the mean water level 26 in the bucket.

For the washing out of the cleaning textile, the first actuating device 3 is actuated in the form of the lever 18. The wash-out basket 11 is thereby set into rotation 4.

Once the cleaning textile 8 has been washed out, the second actuating device 5 is operated in the form of the handle 10 and the ballpoint-pen mechanism 13.

Starting from the lowest first position 16, the basket 2, which previously still had the function of a wash-out basket 11, is pulled into the highest second position 17 by means of the handle 10, as shown in FIG. 2. By means of the ballpoint-pen mechanism 13, the basket 2 engages in its highest second position 17 and then has the function of a spin-dry basket 12. The spin-dry basket 12 is located completely above the mean water level 26 in the bucket 1.

The tensile force, for moving the basket 2 from its lowest first position 16 to its highest second position 17, is transmitted through the coupling 24, which connects the basket 2 and the cleaning device 7.

In FIG. 2 the previously washed-out cleaning textile 8 is spin dried. For this purpose, the basket 2 is moved into the highest second position 17 by means of the ballpoint-pen mechanism 13 as described above, and is again set into rotation 4 by the first actuating device 3 in the form of the lever 18.

Figure 3:
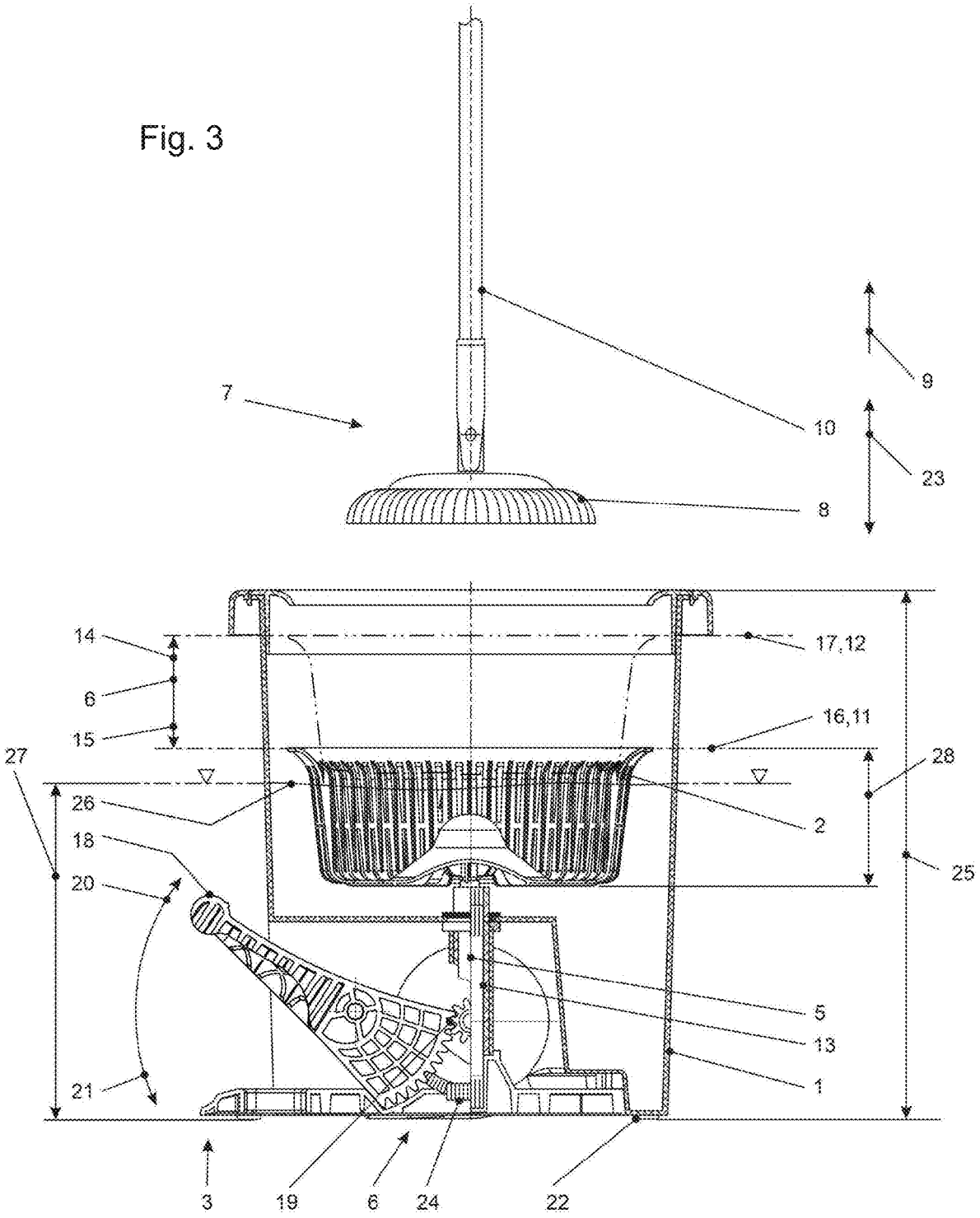
FIG. 3: the removal of the cleaning device from the spin-dry basket before the latter descends back in the bucket into the position shown in FIG. 1.

In FIG. 3, the cleaning textile 8 of the cleaning device 7 is largely spin dried and is removed from the basket 2 by the user. This is done by increasing the tensile force, wherein the tensile force for detaching the coupling 24 is less than the weight force of the liquid-filled bucket 1. As a result, the bucket 1 remains standing securely when the coupling 24 is detached, and the cleaning device 7 can be safely removed from the basket 2.

As a result of the renewed automatic actuation of the ballpoint-pen mechanism 13 when the coupling 24 is detached, the basket 2 then automatically slides back again into the lowest first position 16 shown in FIG. 1 and is thereby prepared if the cleaning textile 8 of the cleaning device 7 is to be washed out again.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning system, comprising:

a bucket;

a liquid-permeable basket located in the bucket, the basket being settable into rotation using a first actuating device and being arranged so that a height of the basket is adjustable in the bucket using a second actuating device; and a cleaning device having a cleaning textile, the cleaning device having a handle on a side facing away from the cleaning textile, wherein the basket is configured both as a wash-out basket and as a spin-dry basket for the cleaning textile, wherein the second actuating device comprises the handle and a ballpoint-pen mechanism, by which the basket is positionable in a first position lowest in the bucket and a second position highest in the bucket by moving the handle up and down, wherein the basket and the cleaning device are detachably connected to one another by a coupling in a rotationally fixed manner, and in a manner that is resistant to tensile stress in the axial direction and non-destructive, wherein the coupling transmits a tensile force corresponding at least to a weight force of the basket during use of the cleaning system, and wherein the coupling transmits a tensile force that is less than a weight force of the liquid-filled bucket.

2. The cleaning system according to claim 1, wherein the first actuating device comprises a lever and a transmission, and wherein the lever and the transmission are functionally connected in order to convert an up and down movement of the lever into a rotational movement of the basket in the lowest first and highest second position of the basket.

3. The cleaning system according to claim 1, wherein the bucket has a bottom which forms an abutment for the ballpoint-pen mechanism and limits the lowest first position.

4. The cleaning system according to claim 3, wherein the ballpoint-pen mechanism is arranged in an axial direction between the basket and the bottom.

5. The cleaning system according to claim 1, wherein the coupling comprises a locking and/or magnetic coupling.

6. The cleaning system according to claim 1, wherein, during use of the cleaning system, the bucket has a mean water level at a height of the bucket, and wherein the cleaning textile and the basket in the lowest first position are arranged completely below the mean water level in the bucket and in the highest second position completely above the mean water level in the bucket.

7. The cleaning system according to claim 6, wherein the bucket has a maximum internal height that corresponds essentially to twice a height of the mean water level in the bucket and essentially to twice a height of the basket.

* * * * *